US006721709B1

(12) United States Patent
Yoo et al.

(10) Patent No.: US 6,721,709 B1
(45) Date of Patent: Apr. 13, 2004

(54) DIGITAL DATA PLAYER, AND DATA PROCESSING METHOD AND DATA STORAGE MEDIUM FOR THE SAME

(75) Inventors: Jae-Ha Yoo, Koyang (KR); Myeong-Joon Kang, Pyungtaek (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/556,438

(22) Filed: Apr. 24, 2000

(30) Foreign Application Priority Data

Apr. 24, 1999 (KR) ..... 1999-14746

(51) Int. Cl.[7] ..... G10L 19/00
(52) U.S. Cl. ..... 704/500; 704/277
(58) Field of Search ..... 714/752; 713/176; 704/277; 386/52; 369/53.41; 341/123; 700/83

(56) References Cited

U.S. PATENT DOCUMENTS

| | | | | | |
|---|---|---|---|---|---|
| 6,061,793 | A | * | 5/2000 | Tewfik et al. | 713/176 |
| 6,134,695 | A | * | 10/2000 | Sasaki et al. | 714/752 |
| 6,192,344 | B1 | * | 2/2001 | Lee et al. | 704/277 |
| 6,208,276 | B1 | * | 3/2001 | Snyder | 341/123 |
| 6,351,442 | B1 | * | 2/2002 | Tagawa et al. | 369/53.41 |
| 6,393,196 | B1 | * | 5/2002 | Yamane et al. | 386/52 |
| 2002/0151992 | A1 | * | 10/2002 | Hoffberg et al. | 700/83 |

OTHER PUBLICATIONS

Noll, "MPEG digital audio coding—Setting the standard for high–quality audio compression", IEEE signal processing magazine, Sep. 1997, ISSN 1053–5888, Sep. 1997, p. 59–81, p. 59–81).*

International Standard ISO/IEC 11172–3, First edition Aug. 1, 1993, p. vi and 34.*

* cited by examiner

*Primary Examiner*—Richemond Dorvil
*Assistant Examiner*—Kinari Patel
(74) *Attorney, Agent, or Firm*—Birch, Stewart, Kolasch & Birch, LLP

(57) ABSTRACT

In the digital player, a decoder, having at least first and second decoding functions, identifies a type of digital data output from a data storage medium. Based on the identification, the decoder selects one of the first and second decoding functions, and decodes the output digital data using the selected decoding function. A converter converts the decoded digital data to analog. To store digital data on the data storage medium, an encoder encodes a first type of digital data at a first compression rate, and stores the encoded first type of digital data on the data storage medium, which stores digital data of a second type encoded at a second compression rate. The first compression rate is higher than the second compression rate. A selector, having at least a first and second input for the first type of digital data, selectively outputs the first type of digital data received at one of the first and second inputs to the encoder.

9 Claims, 3 Drawing Sheets

DIGITAL DATA PLAYER, AND DATA PROCESSING METHOD AND DATA STORAGE MEDIUM FOR THE SAME

BACKGROUND OF THE INVENTION

1. Field of the Invention

The present invention relates in general to enhancing the memory utilization efficiency of a digital data player such as an MP3 player, and more particularly to a digital data player, and a data processing method and a data storage medium for the same, in which information with a relatively small unit-capacity such as a voice or text is stored for reproduction in memory space remaining after files with relatively large unit-capacities such as a music file are assigned.

2. Description of the Prior Art

A digital data player such as an MP3 player is a new notional, portable digital audio reproduction device capable of readily downloading and reproducing desired music from a computer communication network using an audio data compression coding technique prescribed in MPEG1 Layer3.

The MP3 player reproduces audio from an MP3 file, which has a high compression rate as well as resulting in a sound quality indistinguishable from a compact disk (CD). In particular, with the development of a portable MP3 player, the supply of MP3 files is explosively increasing all over the world.

With reference to FIG. 1, there is shown in block form the construction of a conventional MP3 player. As shown in this drawing, the MP3 player includes a data storage medium 101 for storing an MP3 file (i.e., compressed according to an MPEG1 Layer3 coding technique), a decoder 102 for decoding an MP3 bit stream from the data storage medium 101 according to a predetermined decoding algorithm to output a sound signal in a digital form, and a digital/analog (D/A) converter 103 for converting the digital sound signal from the decoder 102 into an analog sound signal and for outputting the converted analog sound signal to a loudspeaker 104.

The operation of the conventional MP3 player with the abovementioned construction will hereinafter be described with reference to FIG. 2.

First, an MP3 file is stored in the data storage medium 101, which may typically be a flash memory or memory card. FIG. 2 illustrates an example of the data storage medium 101 in which MP3 files of M music tunes are stored. The data storage medium 101 provides an MP3 bit stream to the decoder 102, which then decodes the MP3 bit stream according to the predetermined decoding algorithm to output a digital sound signal. The D/A converter 103 converts the digital sound signal from the decoder 102 into an analog sound signal and outputs the converted analog sound signal to the loudspeaker 104.

Generally, in the MP3 player, one music tune occupies a 3~5-Mbyte memory area. As a result, even when the capacity to store music tunes has been filled, an idle area 101A exists in the data storage medium 101. The idle area 101A has a capacity of about 3 Mbytes when the music tune capacity of the data storage medium 101 has been filled. In this regard, the conventional MP3 player has a disadvantage in that the idle area in the high-cost memory 101 remaining after the music files are stored is left unused, resulting in inefficient resource utilization.

SUMMARY OF THE INVENTION

Therefore, the present invention has been made in view of the above problem, and it is an object of the present invention to provide a digital data player in which use is made of the idle area of a digital data storage medium.

It is another object of the present invention to provide a method for storing additional information in an idle area of a memory used for a digital data player.

It is yet another object of the present invention to provide a data storage medium for a digital data player which has a plurality of areas for storing digital data of different compression rates.

These and other objects are achieved by providing a digital player, comprising a decoder, having at least first and second decoding functions, identifying a type of digital data output from a data storage medium, selecting one of said first and second decoding functions based on said identified type, and decoding said output digital data using said selected decoding function and a converter converting said decoded digital data to analog.

These and other objects are further achieved by a digital player, comprising a first decoder, having a first decoding function, and decoding digital data according to said first decoding function, a second decoder, having a second decoding function, and decoding digital data according to said second decoding function, a controller identifying a type of digital data output from a data storage medium, selectively sending said output digital data to one of said first and second decoder based on said identified type, and a converter converting said decoded digital data output from said first and second decoders to analog.

These and other objects are still further achieved by a digital data recorder, comprising a first encoder encoding a first type of digital data at a first compression rate, and storing said encoded first type of digital data on a data storage medium, which stores digital data of a second type encoded at a second compression rate, said first compression rate higher than said second compression rate, and a selector, having at least a first and second input for said first type of digital data, and selectively outputting said first type of digital data received at one of said first and second inputs to said encoder.

These and other objects are also achieved by a data storage medium for a digital data player comprising a first compressed data region for storing a first digital data bit stream compressed according to a first compression algorithm, a second compressed data region for storing a second digital data bit stream compressed according to a second compression algorithm having a compression rate higher than that of said first compression algorithm, said second compressed data region forming one region of a specific area on said data storage medium, and a text data region for storing text data, said text data region forming another region of said specific area.

These and other objects are additionally achieved by a method of reproducing digital data, comprising identifying a type of digital data output from a data storage medium, selecting one of a first and second decoding function based on said identified type, decoding said output digital data using said selected decoding function, and converting said decoded digital data to analog.

These and other objects are further achieved a method of recording digital data, comprising selectively outputting a first type of digital data received at one of a first and second input, encoding said output first type of digital data at a first compression rate, storing said encoded first type of digital data on a data storage medium, which stores digital data of a second type encoded at a second compression rate, said first compression rate higher than said second compression rate.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
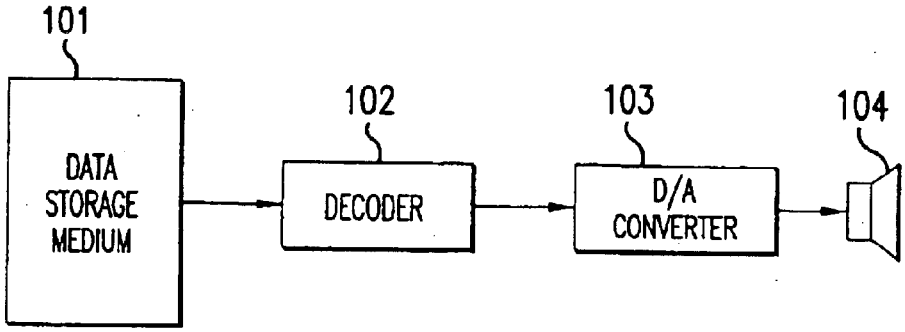
FIG.1 PRIOR ART
FIG. 1 is a block diagram of a conventional MP3 player.
Figure 2:
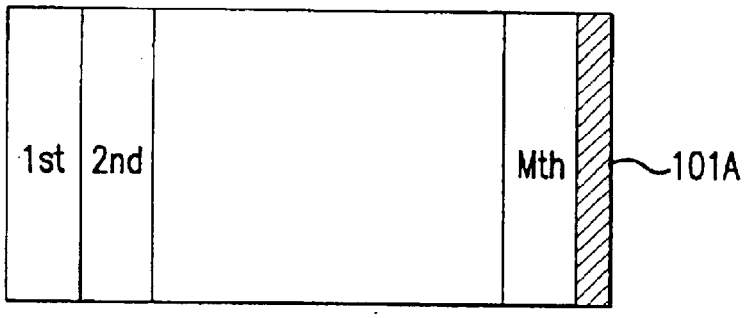
FIG.2 PRIOR ART
FIG. 2 is a view illustrating a format of an idle area of a memory in which digital data is stored.
Figure 3:
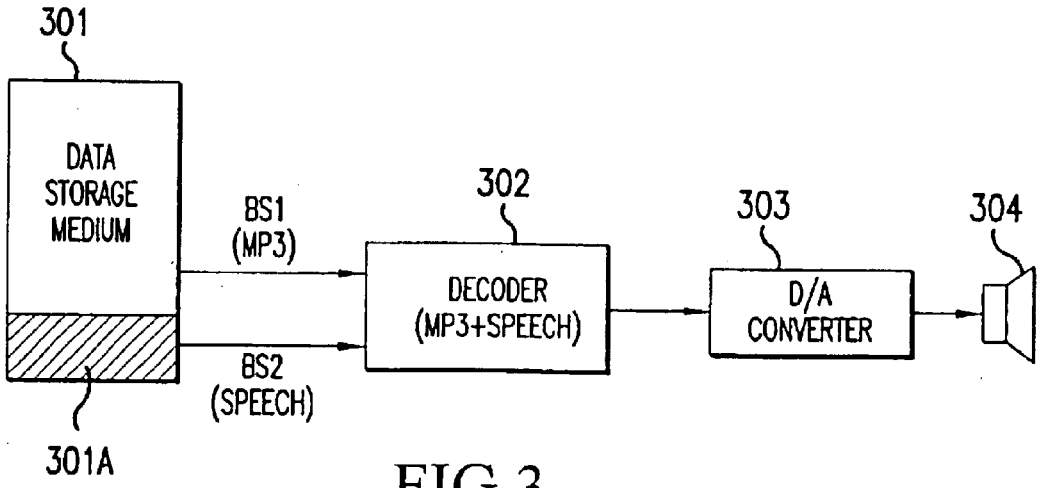
FIG. 3 is a block diagram of a digital data player in accordance with an embodiment of the present invention.

With reference to FIG. 3, there is shown in block form the construction of a multi-purpose digital data player in accordance with an embodiment of the present invention. As shown in this drawing, the digital data player includes a data storage medium 301 for storing a plurality of MP3 file bit streams and for further storing a speech bit stream in an idle area remaining after assigning the MP3 file bit streams. A decoder 302 decodes an output MP3 file bit stream BS1 from the data storage medium 301 according to an MP3 decoding algorithm. The decoder 302 further decodes an output speech bit stream BS2 from the data storage medium 301 according to a speech decoding algorithm. A D/A converter 303 converts the digital MP3 file signal or the digital speech signal output from the decoder 302 into an analog signal and outputs the converted analog signal to a loudspeaker 304.

Now, a detailed description will be given of the operation of the digital data player with the above-mentioned construction in accordance with the preferred embodiment of the present invention.

An idle area 301A in the data storage medium 301 signifies the remaining storage area after MP3 file bit streams are stored in the data storage medium 301. Preferably, the idle area 301A may be utilized to store a variety of signals or information. In the present embodiment, the idle area 301A is shown to store, for example, a speech bit stream compressed according to any well-known speech signal compression technique.

In the present embodiment, the decoder 302 checks a header of an output bit stream from the data storage medium 301. If the header of the output bit stream indicates the output bit stream is an MP3 file bit stream BS1, then the decoder 302 decodes the bit stream BS1 using the MP3 decoding algorithm. Alternatively, if the header of the output bit stream indicates the output bit stream is a speech bit stream BS2, then the decoder 302 decodes the bit stream BS2 using the speech decoding algorithm.

Consequently, the decoder 302 includes the speech decoding algorithm in addition to the typical MP3 decoding function. In this connection, the use of a processor with an appropriate arithmetic capability makes it possible to implement the decoder 302 with no further hardware.

The digital MP3 file signal or digital speech signal from the decoder 302 is D/A-converted by the D/A converter 303 and then output to the loudspeaker 304.

The field of speech compression has made rapid progress and reached such a degree that relatively good sound quality is provided even in low transmission rate environments of 2~4 Kbps. In the case where a compression rate of 4 Kbps is secured as an example of the worst case, only a memory space of about 0.15 Mbyte (4×5×60=1.2 Mbit=0.15 Mbyte) is required for speech output having a duration of about five minutes.

Consequently, a speech signal can be output for a relatively long period of time even when using the idle area 301A as mentioned above. Therefore, it is possible to utilize the idle area 301A in a significant way.

Figure 4:
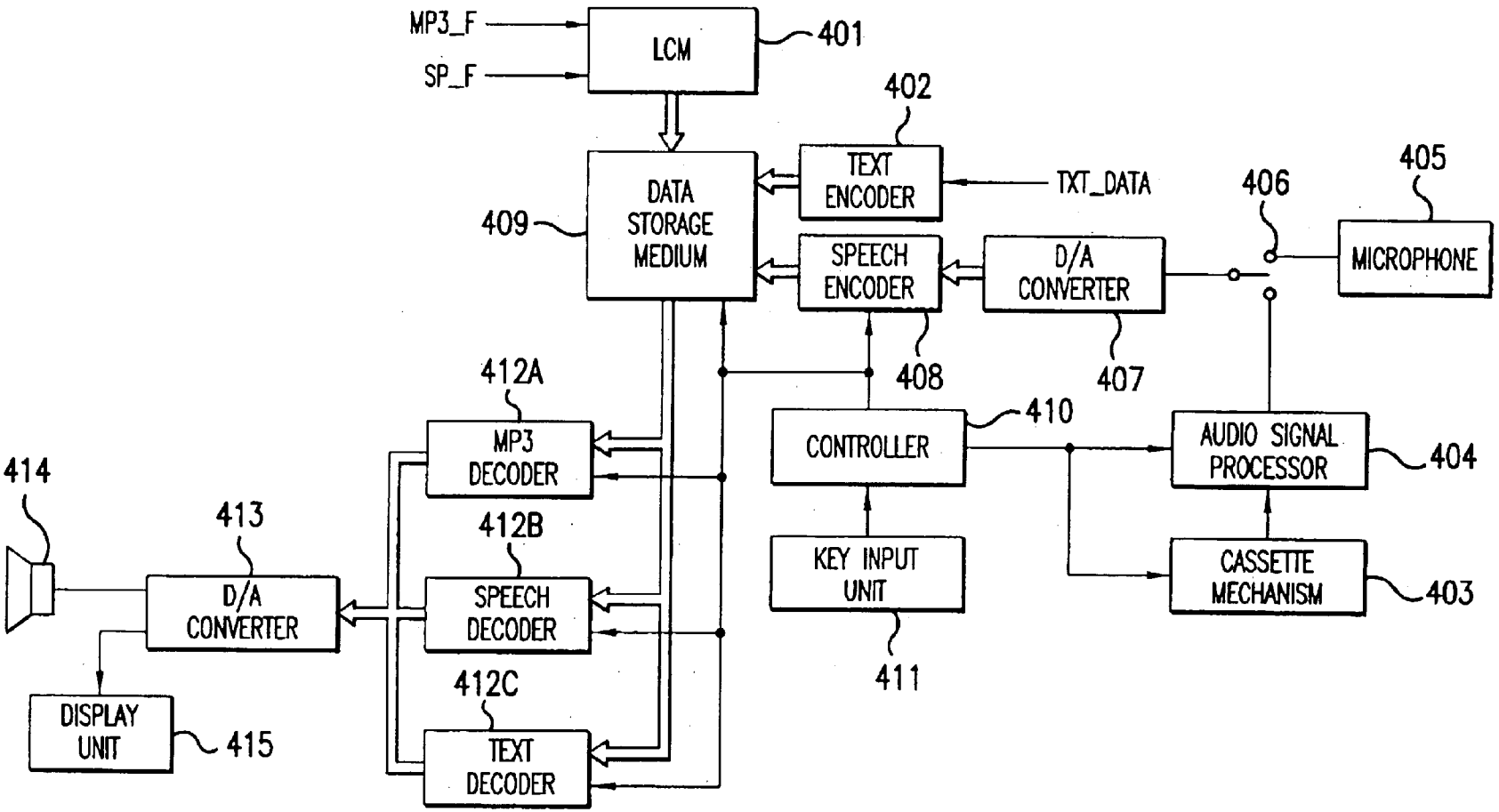
FIG. 4 is a block diagram of a digital data player in accordance with an alternative embodiment of the present invention.

With reference to FIG. 4, there is shown in block form the construction of a speech audible digital data player having a recorder and a player portion in accordance with an alternative embodiment of the present invention. As shown, a licensed SDMI compliant module (LCM) 401 receives MP3 files MP3_F or a speech file SP_F from the Internet or a communication network, and downloads the received MP3 files or speech file to a data storage medium 409, which may typically be a flash memory or memory card. A text encoder 402 encodes externally received text data TXT_DATA in a predetermined manner, and provides the encoded text data for storage in the data storage medium 409.

A cassette mechanism 403 stores an audio signal in a cassette and reproduces the stored audio signal. An audio signal processor 404 processes and reproduces the audio signal from the cassette mechanism 403. A switch 406 selects the audio signal from the audio signal processor 404 or an audio signal from a microphone 405 and transfers the selected audio signal to an analog/digital (A/D) converter 407. The A/D converter 407 converts the audio signal from the switch 406 into a digital audio signal and outputs the converted digital audio signal to a speech encoder 408. The speech encoder 408 encodes the audio signal from the A/D converter 407 in a predetermined manner, and provides the encoded text data for storage in the data storage medium 409.

The data storage medium 409 sequentially downloads and stores the MP3 files from the LCM 401. The data storage medium 409 further stores the speech file from the LCM 401, a text file from the text encoder 402 or an audio signal from the speech encoder 408 in an idle area remaining after assigning the MP3 files. A controller 410 controls the cassette mechanism 403, the data storage medium 409 and other system components in response to the user's control commands inputted through a key input unit 411 to reproduce the MP3 files or various audio signals.

Next, the structure of the digital player portion for reproducing the digital data stored in the data storage medium 409 will be described. The player portion includes an MP3 decoder 412A decoding an output MP3 file from the data storage medium 409. A speech decoder 412B decodes an output speech file from the data storage medium 409. A text decoder 412C decodes an output text from the data storage medium 409. A D/A converter 413 converts digital output signals from the MP3 decoder 412A, the speech decoder 412B and the text decoder 412C into analog signals. A speaker 414 outputs an analog audio signal from the D/A converter 413 externally. A display unit 415 displays text information from the D/A converter 413. The controller 410 controls the operation of the above components. While illustrated as a single device using a common controller 410, the recording section and the player section of the digital data player in FIG. 4 could form two separate, independent devices, each with their own controller.

Next, a detailed description will be given of the operation of the digital data player with the above-mentioned construction in accordance with the second embodiment of the present invention.

Firstly, the MP3 files MP3_F are recorded and reproduced in the following manner.

The LCM 401 receives the MP3 files MP3_F from the Internet or the communication network and downloads the received MP3 files to the data storage medium 409. The controller 410 controls the data storage medium 409 in response to a control command inputted through the key input unit 411 to read a corresponding MP3 file from the data storage medium 409.

The MP3 decoder 412A restores an output MP3 file bit stream from the data storage medium 409 to the original digital signal, which is then converted into an analog signal by the D/A converter 413 and outputted to the speaker 414.

Secondly, a speech file SP_F is recorded and reproduced in the following manner.

The LCM 401 receives the speech file SP_F from the Internet or the communication network and downloads the received speech file to the idle area of the data storage medium 409. This speech file SP_F may be the contents of a lecture for education.

The speech file SP_F becomes much shorter in download time than the MP3 file MP3_F because it is transmitted and stored in the idle area of the data storage medium 409 in a compressed form. In this case, the speech file SP_F may be somewhat degraded in sound quality. For reference, it typically takes about 20 minutes to download one MP3 file MP3_F.

Then, the controller 410 reads the speech file stored in the data storage medium 409 in response to a user's request and supplies the read speech file to the speech decoder 412B. The speech decoder 412B restores the read speech file to the original digital signal, which is then converted into an analog signal by the D/A converter 413 and outputted to the speaker 414.

Thirdly, the user voice signal from the microphone 405 or the audio signal from the cassette mechanism 403 are recorded and reproduced in the below manner.

The controller 410 controls the cassette mechanism 403 in response to the user's request such that the cassette mechanism 403 reproduces an audio signal. The audio signal processor 404 processes the audio signal from the cassette mechanism 403 and then applies the processed audio signal to one input terminal of the switch 406, the other input terminal of which is supplied with the user voice signal from the microphone 405.

The switch 406 performs a switching operation under the control of the controller 410, or manually, to select the cassette audio signal or the microphone audio signal. The selected audio signal is A/D-converted by the A/D converter 407, encoded in a predetermined manner by the speech encoder 408 and stored in the idle area of the data storage medium 409. Then, the stored audio signal is output under the control of the controller 410 along the same path as the speech file.

In this manner, a desired audio signal from the cassette mechanism 403 is stored in the idle area of the data storage medium 409 in a compressed form and repetitively reproduced along the above path. As a result, such repetitive reproduction can be much more conveniently performed as compared with self-repetitive reproduction of the cassette mechanism 403.

Finally, the operation of recording and reproducing the text data TXT_DATA will hereinafter be described.

The external text data TXT_DATA is encoded in a predetermined manner by the text encoder 402 and stored in the idle area of the data storage medium 409. Then, the controller 410 reads the text data from the idle area of the data storage medium 409 and supplies the read text data to the text decoder 412C. The text decoder 412C restores the read text data to the original digital signal. The digital signal is converted into an analog signal by the D/A converter 413 and displayed on the display unit 415. This text data display function can be utilized in various ways such as an auxiliary display for a lecture.

Figure 5:
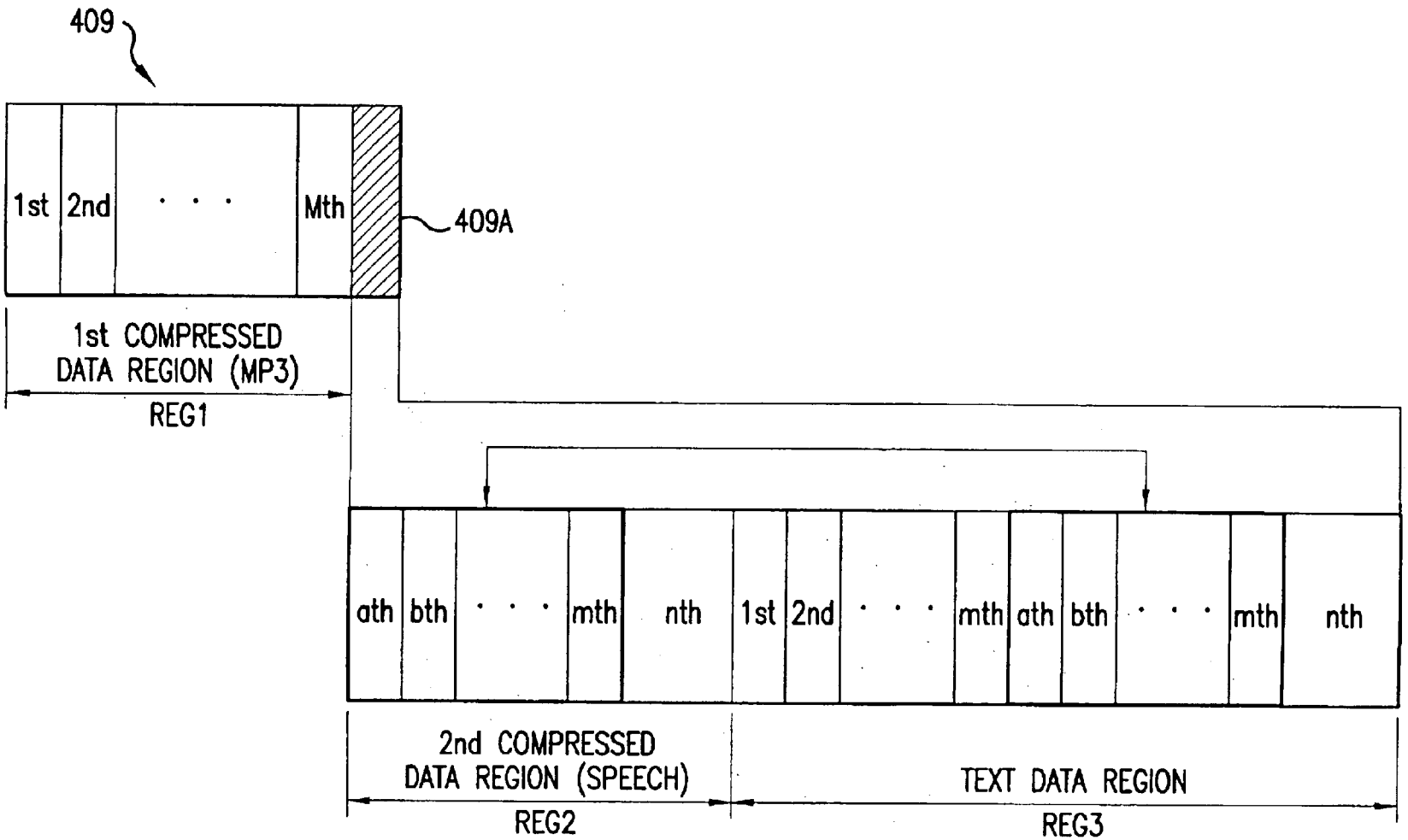
FIG. 5 is a view illustrating a format of a memory idle area in accordance with the present invention.

FIG. 5 is a view illustrating a data format of the idle area 409A of the data storage medium 409 in accordance with the present invention. As shown in this drawing, the data storage medium 409 comprises a first compressed data region REG1 for storing a plurality of MP3 files 1-M in a compressed form, a second compressed data region REG2 in the idle area 409A for storing a plurality of speech data a-m and n in a compressed form, and a text data region REG3 in the idle area 409A for storing a plurality of text data 1-m, a-m and n.

Besides being stored and reproduced independently, the MP3, speech, and text data can be stored in association with one another, and reproduced cooperatively in accordance with that association. When two or more types of data are to be stored and reproduced in association, header information in the primary data type (MP3 data or speech data) includes addresses pointing to the associated data (speech and/or text data). After the primary data is stored, the controller 410 identifies the associated data based on header information included therein. The controller 410 then determines the association between specific primary and associated data units based on the address pointers in the header of the primary data, and the corresponding addresses in the headers of the associated data. Then, as the associated data is stored in the idle area 409A, the controller 410 changes the address pointers in the primary data to the memory addresses in the idle area 409A where the corresponding associated data is stored.

During reproduction, the headers of the reproduced primary data are accessed. From the headers, the controller 410 determines that the idle area 409A stores associated data. And, from the address pointers, the controller 410 causes the associated data to be output from the data storage medium 409 in synchronization with the output of the primary data.

For example, when the MP3 file 1 stored in a compressed form in the first compressed data region REG1 is decoded and outputted, the corresponding text data 1 from the text data region REG3 is outputted and displayed. As a result, the user is able to listen to desired MP3 music while viewing character information such as words or a tune name on the display unit.

As a second example, when the speech data "a" stored in a compressed form in the second compressed data region REG2 is decoded and outputted, the corresponding text data "a" from the text data region REG3 is outputted and displayed. As a result, the user is able to listen to the contents of a lecture while viewing character information such as the main points of the lecture on the display unit.

As a third example, the speech data "n" from the second compressed data region REG2 is individually outputted as mentioned above and, similarly, the text data "n" from the text data region REG3 is individually outputted and displayed in association therewith.

Although the idle area 409A is shown to have a small size, incapable of accommodating one MP3 file, it may be enlarged to encompass part of the first compressed data area REG1 as needed.

As apparent from the above description, according to the present invention, the speech file, the user voice signal or the audio signal from the cassette tape player is stored for reproduction in the idle area of the memory used for the digital data player or, as needed, the text information is stored in the idle area of the memory for the display on the display unit. Therefore, it is possible to provide a variety of services without separately increasing the cost. As a result, a high-cost flash memory can be utilized effectively. This has the effect of contributing to efficient resource utilization.

Although the preferred embodiments of the present invention have been disclosed for illustrative purposes, those skilled in the art will appreciate that various modification, additions and substitutions are possible, without departing from the scope and spirit of the invention as disclosed in the accompanying claims.

What is claimed is:

1. A data reproducing device for reproducing data including at least two types of audio data, wherein at least one of said at least two types of audio data is associated with text data for reproduction, said at least two types of audio data including:

a first type of audio data; and a second type of audio data having been formatted in a different manner from the first type of audio data, wherein a compression rate is one factor causing the difference in formatting manner, the data reproducing device comprising:

a first decoder provided to decode the first type of audio data;

a second decoder provided to decode the second type of audio data in a different decoding manner from the first decoder, wherein the first decoder and the second decoder are functionally separated from each other; and a selector, having at least a first output and a second output separated from each other, for selectively directing one of said outputs to the corresponding one of the first decoder and the second decoder.

2. The data reproducing device of claim 1, further comprising:

a third decoder, having a third decoding function, and decoding digital data according to said third decoding function.

3. The data reproducing device of claim 2, wherein said first decoder decodes MP3 files;

said second decoder decodes speech; and said third decoder decodes text.

4. The data reproducing device of claim 1, wherein said controller reads a header of said output digital data, and identifies a type of said digital data based on said read header.

5. The data reproducing device of claim 1, wherein said controller determines whether at least another type of digital data is associated with said identified type of digital data based on said read header, and controls output of said identified type of digital data and said another type of digital data from said data storage medium such that said identified type of digital data and said another type of digital data are supplied to an appropriately different ones of said first and second decoders for decoding.

6. The data reproducing device of claim 5, wherein said first decoder decodes MP3 files;

said second decoder decodes speech;

and said controller supplies said identified digital data to said first decoder and said another type of digital data to said second decoder when (i) said identified digital data is identified as an MP3 file and said another type of digital data is speech data and (ii) said read header of said MP3 file indicates an association with said speech data.

7. A data recorder for recording data including at least two types of audio data, wherein at least one of said at least two types of audio data is associated with text data for reproducing, said at least two types of audio data including:

a first type of audio data; and a second type of audio data formatted in a different manner from the first type of audio data, wherein a compression rate is one factor causing the different in formatting manner, the data reproducing device comprising:

a first formatter provided to format the first type of audio data;

a second formatter provided to format the second type of audio data in a different formatting manner from the first formatter; and a selector, having at least a first input and a second input separated from each other for the first type of audio data and the second type of audio data, and selectively directing one of the inputs to the corresponding one of the first formatter and the second formatter.

8. The data recorder of claim 7, further comprising:

a microphone connected to said first input; and an output of a magnetic tape reproducing device connected to said second input.

9. The data recorder of claim 7, further comprising:

a controller controlling said selector based on key input from an operator.

* * * * *